United States Patent [19]

Shinozaki et al.

[11] Patent Number: 5,022,919

[45] Date of Patent: Jun. 11, 1991

[54] COMPLEX BORIDE CERMETS AND PROCESSES FOR THEIR PRODUCTION

[75] Inventors: Yasuo Shinozaki, Sagamihara; Noritoshi Horie, Tokyo; Kazuo Hamashima, Yokohama; Makoto Imakawa, Yokohama, all of Japan

[73] Assignee: Asahi Glass Company Ltd., Tokyo, Japan

[21] Appl. No.: 352,414

[22] Filed: May 16, 1989

[30] Foreign Application Priority Data

Jul. 8, 1988 [JP] Japan ..... 63-168930

[51] Int. Cl.[5] ..... C22C 29/04

[52] U.S. Cl. ..... 75/238; 75/244; 419/12; 419/17

[58] Field of Search ..... 75/244, 238; 419/12, 419/17

[56] References Cited

U.S. PATENT DOCUMENTS

| | | | |
|---|---|---|---|
| 2,088,981 | 8/1937 | Sturgis | 75/244 |
| 2,776,468 | 1/1957 | Steinitz | 75/244 |
| 3,903,238 | 9/1975 | Grinder et al. | 420/430 |

FOREIGN PATENT DOCUMENTS

| | | |
|---|---|---|
| 56-15773 | 4/1981 | Japan . |
| 63-143236 | 6/1988 | Japan . |
| 2109409 | 6/1983 | United Kingdom . |
| 8000575 | 4/1980 | World Int. Prop. O. . |

OTHER PUBLICATIONS

Powder Met. Bull., 6, 123 (1953), (Steinitz & Binder).
Powder Met. Bull., 6, 154 (1953), (Binder & Roth).
P. T. Kolomytsev, N. V. Moskaleva, Poroshkovays Metallurgiya No. 8 (44), Aug. 1966, pp. 665-670.

*Primary Examiner*—Stephen J. Lechert, Jr.
*Assistant Examiner*—Leon Nigohosian, Jr.
*Attorney, Agent, or Firm*—Oblon, Spivak, McClelland, Maier & Neustadt

[57] ABSTRACT

A complex boride cermet having high strength and high toughness, which comprises a hard phase composed mainly of a boride of $(Mo_{1-x}W_x)_2NiB_2$ formed by substituting a part of Mo of $Mo_2NiB_2$ by W, and a matrix alloy phase composed mainly of Ni and containing Mo, and a complex boride cermet comprising a hard phase composed mainly of $Mo_2NiB_2$ or $(Mo_{1-x}W_x)_2NiB_2$ and a matrix of an alloy phase composed mainly of Ni and containing Mo, which is characterized in that carbon or/and nitrogen, and optionally at least one metal selected from the metals of Groups 4B and 5B and Cr, are incorporated to further improve the strength and toughness. Such complex boride cermet has high strength and high toughness and maintains such properties even at elevated temperatures of from 600° to 900° C. Also disclosed is a process for producing a complex boride cermet containing carbon or/and nitrogen, and optionally at least a carbide or/and a nitride of a metal selected from the metals of Groups 4B, 5B and 6B are added to the starting material.

28 Claims, No Drawings

COMPLEX BORIDE CERMETS AND PROCESSES FOR THEIR PRODUCTION

BACKGROUND OF THE INVENTION

1. Field of the Invention

The present invention relates to a complex boride cermet having a hard phase composed of a nickel-molybdenum complex boride and a complex boride cermet having a hard phase composed of a nickel-molybdenum complex boride with a part of the molybdenum substituted by tungsten. Particularly, it relates to a complex boride cermet having high strength, toughness, and thermal shock resistance, and the high strength is maintained even at elevated temperatures.

2. Discussion of Background

As a representative cermet which is practically used and enjoys a large market share, the cemented carbide (WC-Co cermet) may be mentioned.

This cermet is one of rare cermets practically used among a number of cermets so far studied.

For the cemented carbide (WC-Co cermet), many applications have already been established by virtue of its excellent properties such as high strength and high hardness.

However, it has a weak point such that when it is heated in atmospheric air to a temperature of 500° C., tungsten carbide (WC) will be oxidized, whereby the strength decreases.

Whereas, a metal boride has a high melting point, high hardness and excellent corrosion resistance and oxidation resistance at high temperatures, and it is a good conductor of electricity and heat. Therefore, to utilize such properties of the boride, its application to e.g. mechanical parts where heat resistance and abrasion resistance are required, has been attempted with ceramics of the boride.

Especially, with respect to diboride ceramics such as titanium boride ($TiB_2$) or zirconium boride ($ZrB_2$), extensive research has been conducted (Journal of Japan Metal Association, 25, (12), 1081, 1986). Some of them have been practically used.

However, these borides are hardly sinterable materials, whereby it is difficult to obtain dense sintered bodies by a usual sintering method (pressureless sintering). (Hibata, Hashimoto, Quaternary Journal of Osaka Kogyo Gijytsu Shikenjo, 18, 216, 1967)

Whereas, it has been proposed to obtain a dense sintered body by using a sintering additive (Watanabe, Ishibai Powder and Powder Metallurgy, 26, 304, 1979) or by using hot pressing, and it has been made possible to obtain a sintered body having a density of almost 100%. However, for its application to mechanical parts or the like, such sintered body is still inadequate in the strength or toughness.

On the other hand, it has been proposed to bind such hardly sinterable boride with a matrix of a metal phase to obtain a complex material (cermet) wherein the properties of the boride are utilized (Kinoshita, Kose, Hamano, Journal of Ceramic Association, 75, 84, 1967, and Y. Yuriditskii et al, Poroshkovaya Metalluegiya., No. 4, (232), 32, 1982).

In this case, a dense sintered body is obtainable by a usual pressureless sintering method. However, from the viewpoint of strength, the product is still unsatisfactory.

The reason may be explained as follows.

Namely, the matrix of a metal phase which is expected to provide toughness, preferentially reacts with the boride and is converted to a brittle boride. For example, iron is converted to $Fe_2B$ or $FeB_{12}$, and Ni is converted to $Ni_2B$, $Ni_4B_3$ or NiB, whereby the sintered body tends to be brittle.

Japanese Examined Patent Publication No. 15773/1981 (applicant: Toyokohan K.K.) proposes a high strength complex boride cermet to solve this problem. However, also in this case, the metal phase matrix is an iron base, whereby there are some problems in the corrosion resistance or oxidation resistance at high temperatures, and the properties of borides are not adequately utilized, particularly with respect to the strength at high temperatures. With respect to the phase relation of a Ni-Mo-B system, there has been a report by P. T. Kolomytsev and N. V. Moskaleva (Poroshkovaya Metalluegiya, No. 8, (44), 86, 1966). It has been reported that there exists a complex boride crystal phase of a tetragonal system having a composition of $Mo_2NiB_2$ and a nickel alloy phase containing molybdenum.

SUMMARY OF THE INVENTION

The present inventors have conducted researches upon such combination of the complex boride and nickel alloy as the basis of cermet and studied to utilize the original properties of a boride and to improve properties of boride cermet such as strength, toughness and thermal shock resistance, particularly the strength at high temperatures of from 600° C. to 1,000° C.

The present invention has been accomplished to solve the above object and provides a first complex boride cermet having high strength and high fracture toughness, which comprises a hard phase composed mainly of a complex boride ($(Mo_{1-x}W_x)_2NiB_2$) being a solid solution of a nickel-molybdenum complex boride ($Mo_2NiB_2$) with a part of the molybdenum substituted by tungsten, and a matrix of an alloy phase composed mainly of nickel and containing molybdenum.

In a preferred embodiment of the first complex boride cermet of the present invention, the molar ratio x of tungsten substituted for molybdenum in the complex boride is within a range of from 0.02 to 0.60.

In another preferred embodiment of the first complex boride cermet of the present invention, the molar ratio x is within a range of from 0.04 to 0.40.

In another preferred embodiment of the first complex boride cermet of the present invention, the hard phase of the complex boride is from 40 to 90% by weight, and the matrix alloy phase is from 10 to 60% by weight.

In another preferred embodiment of the first complex boride cermet of the present invention, the matrix alloy phase contains at least 40% by weight of nickel.

In another preferred embodiment of the first complex boride cermet of the present invention, the hard phase of the complex boride is from 40 to 95% by weight, the matrix alloy phase is from 5 to 60% by weight, and the matrix alloy phase contains at least 40% by weight of nickel.

A second complex boride cermet of the present invention is a cermet having high strength and high toughness, which comprises a hard phase composed mainly of a nickel-molybdenum complex boride or a nickel-molybdenum complex boride with a part of the molybdenum substituted by tungsten, and a matrix of an alloy phase composed mainly of nickel and containing molybdenum, and which contains carbon in its sintered body.

A preferred embodiment of the second complex boride cermet of the present invention contains at least one metal selected from the metals of Groups 4b and 5b of the Periodic Table and chromium.

Another preferred embodiment of the second complex boride cermet of the present invention contains from 5 to 60% by weight of the matrix alloy phase.

Another preferred embodiment of the second complex boride cermet of the present invention contains from 10 to 45% by weight of the matrix alloy phase.

In another preferred embodiment of the second complex boride cermet of the present invention, carbon contained in the sintered body is from 0.05 to 3.0% by weight, and the total content of the metals of Groups 4B and 5B the Periodic Table and chromium is from 0.2 to 32% by weight.

Another preferred embodiment of the second complex boride cermet of the present invention contains one or both of tantalum and niobium in the sintered body, whereby the total content of tantalum and niobium is from 0.5 to 32% by weight, and the content of carbon is from 0.05 to 3.0% by weight.

According to a process for producing the second complex boride cermet of the present invention, from 0.25 to 35% by weight of a carbide or carbides of metal selected from the metals of Groups 4B, 5B and 6B of the Periodic Table is added to the starting material for sintering, whereby it is possible to obtain a complex boride cermet having high strength and high toughness, which comprises a hard phase composed mainly of a nickel-molybdenum complex boride or a nickel-molybdenum complex boride with a part of the molybdenum substituted by tungsten, and a matrix of an alloy phase composed mainly of nickel and containing molybdenum.

A third complex boride cermet of the present invention is a cermet having high strength and high toughness, which comprises a hard phase composed mainly of a nickel-molybdenum complex boride or a nickel-molybdenum complex boride with a part of the molybdenum substituted by tungsten, and a matrix of an alloy phase composed mainly of nickel and containing and which contains nitrogen in its sintered body.

A preferred embodiment of the third complex boride cermet of the present invention contains from 5 to 60% by weight of the matrix alloy phase and further contains at least one metal selected from the metals of Groups 4B and 5B of the Periodic Table and chromium, in addition to nitrogen in the sintered body.

Another preferred embodiment of the third complex boride cermet of the present invention contains from 10 to 45% by weight of the matrix alloy phase.

In another preferred embodiment of the third complex boride cermet of the present invention, nitrogen contained in the sintered body is from 0.02 to 2.0% by weight, and the total content of the metals of Groups 4B and 5B of the Periodic Table and chromium is from 0.1 to 20% by weight.

Another preferred embodiment of the third complex boride cermet of the present invention contains from 0.1 to 20% by weight of tantalum of Group 5B and from 0.02 to 1.2% by weight of nitrogen, in the sintered body.

According to the process for producing the third complex boride cermet of the present invention, from 0.12 to 22% by weight of a nitride or nitrides of metal selected from the metals of Groups 4B, 5B and 6B of the Periodic Table is added to the starting material for sintering, whereby it is possible to obtain a complex boride cermet having high strength and high toughness, which comprises a hard phase composed mainly of a nickel-molybdenum complex boride or a nickel-molybdenum complex boride with a part of the molybdenum substituted by tungsten, and a matrix of an alloy phase composed mainly of nickel and containing molybdenum.

A fourth complex boride cermet of the present invention is a complex boride cermet having high strength and high toughness, which comprises a hard phase composed mainly of a nickel-molybdenum complex boride or a nickel-molybdenum complex boride with a part of the molybdenum substituted by tungsten, and a matrix of an alloy phase composed mainly of nickel and containing molybdenum, and which contains nitrogen and carbon in its sintered body.

A preferred embodiment of the fourth complex boride cermet of the present invention contains at least one metal selected from the metals of Groups 4B and 5B of the Periodic Table and chromium in addition to nitrogen and carbon in the sintered body.

Another preferred embodiment of the fourth complex boride cermet of the present invention contains from 5 to 60% by weight of the matrix alloy phase.

Another preferred embodiment of the fourth complex boride cermet of the present invention contains from 10 to 45% by weight of the matrix alloy phase.

In another preferred embodiment of the fourth complex boride cermet of the present invention, carbon contained in the sintered body is from 0.05 to 3% by weight, and nitrogen in the sintered body is from 0.02 to 2% by weight.

In another preferred embodiment of the fourth complex boride cermet of the present invention, carbon contained in the sintered body is from 0.1 to 2% by weight, and nitrogen contained in the sintered body is from 0.05 to 1% by weight.

According to a process for producing the fourth complex boride cermet of the present invention, a carbide or carbides and a nitride or nitrides of metal selected from the metals of Groups 4B, 5B and 6B of the Periodic Table are added in a total amount of from 0.7 to 45% by weight to the starting material for sintering to obtain a complex boride cermet having high strength and high toughness, which comprises a hard phase composed mainly of a nickel-molybdenum complex boride or a nickel-molybdenum boride with a part of the molybdenum substituted by tungsten, and a matrix of an alloy phase composed mainly of nickel and containing molybdenum.

The present invention firstly provides a complex boride cermet having high strength and high toughness, which comprises a hard phase composed mainly of a complex boride ($(Mo_{1-x}W_x)_2NiB_2$) being a solid solution of a nickel molybdenum complex boride ($Mo_2NiB_2$) with a part of the molybdenum substituted by tungsten, and a matrix of an alloy phase composed mainly of nickel and containing molybdenum.

The present invention also provides a cermet having high strength (particularly there is no substantial decrease in the strength at a temperature of about 800° C.) and high toughness, which comprises a hard phase composed mainly of a nickel-molybdenum complex boride ($Mo_2NiB_2$) or a nickel-molybdenum complex boride with a part of the molybdenum substituted by tungsten ($(Mo_{1-x}W_x)_2NiB_2$) and a matrix of an alloy phase composed mainly of nickel and containing molybdenum, wherein carbon or/and nitrogen are incorporated. Preferably, at least one carbide or/and nitride selected from the carbides and nitrides of metals of Groups 4B, 5B and 6B of the Periodic Table, is added to the starting material, whereby the cermet can readily be densified by a usual pressureless sintering method.

For the sake of simplicity of description, the chemical components and chemical compounds will be shown by chemical symbols where appropriate.

Starting materials useful for obtaining a sintered body of the complex boride cermet composed of a nickel-molybdenum complex boride with Mo partly substituted by W according to the present invention, may suitably be selected depending upon the desired sintered body. However, as the combination of main starting materials, either a combination of MoB and Ni or a combination of Ni-B alloy and Mo, is preferred.

MoB powder used here should preferebly be as pure as possible and as fine as possible from the viewpoint of the properties of the complex boride cermet obtained by sintering.

Specifically, it is preferred to employ MoB powder having a purity of at least 99% and an average particle size of at most 5 μm, more preferably at most 2 μm.

Likewise, Ni powder should also be as fine as possible in order to reduce inclusion of impurities due to oxidation resulting from milling or due to abrasion of the milling apparatus. For example, it is preferred to employ Ni powder having a purity of at least 99.5% by weight and an average particle size of about 1.5 μm, which may be prepared by e.g. a carbonyl method.

Further, in a case where Ni-B alloy and Mo are employed, they are preferably powders as pure as possible and as fine as possible. For example, they are preferably powders having a purity of at least 98% and an average particle size of at most 10 μm.

As a starting material for tungsten present in substitution for a part of Mo, a metal tungsten and/or tungsten boride may preferably be employed as the starting material.

Also in this case, the purity is preferably as high as possible. Specifically, it is preferred to employ a material having a purity of at least 99%.

Further, the particle size is preferably at most 10 μm as an average particle size.

To obtain a sintered product of the first boride cermet of the present invention, for example, these starting powder materials are mixed, and the mixture is mixed and milled in a wet system, then dried and pressmolded, and the molded body is sintered at a temperature of at least 1,000° C., usually from 1,100° C. to 1,500° C. in a neutral atmosphere such as argon or vacuum, or in a reducing atmosphere such as hydrogen.

During this sintering, the composition of the molded body changes from the starting materials to a hard phase composed of a complex boride of $(Mo_{1-x}W_x)_2NiB_2$ and the matrix of an alloy phase composed mainly of Ni, when W is substituted for Mo in the complex boride, and further a part of W is solid-solubilized in the alloy phase of Ni to reinforce the boundary between the crystal grain of the complex boride and the matrix of the alloy phase and to form a sintered body.

In a preferred structure of the sintered body of the complex boride cermet of the present invention, spaces among the complex boride crystals of nickel, molybdenum and tungsten and having an average grain size of at most 5 μm, are filled with the alloy phase matrix composed mainly of nickel in a thickness of at most 2 μm.

More specifically, it is represented by the formula $(Mo_{1-x}W_x)_2NiB_2$ and is a solid solution obtained by substituting a part of Mo in the complex boride of $Mo_2NiB_2$ by W.

Here, the preferred proportion represented by x is from 0.02 to 0.6, more preferably from 0.04 to 0.4. If the molar ratio x in the present invention is less than 0.02, no adequate effect for improving the strength and toughness is obtainable. On the other hand, if the molar ratio is higher than 0.6, undesirable phenomena such as a decrease in the oxidation resistance or an increase in the specific gravity of the material tend to result.

Next, nickel contained in the matrix composed of the nickel alloy is preferably at least 40% by weight, more preferably at least 50% by weight. If the content of nickel is small, the mutual solid-solubilization between the complex boride crystal phase of $(Mo_{1-x}W_x)_2NiB_2$ and the alloy phase matrix tends to decrease, whereby the bonding strength tends to be weak.

As alloy components other than nickel, iron, cobalt, chromium and molybdenum are preferred. However, if these components are incorporated in large amounts, a brittle metal compound will be formed, and the toughness of the sintered body tends to be low, such being undesirable.

The preferred content of Ni in the alloy phase is from 50 to 98% by weight.

For example, when the matrix of the alloy phase is composed of Ni alloy containing from 0.5 to 20% by weight of chromium, the oxidation resistance at high temperatures is improved.

In the complex boride cermet sintered body of the present invention, the proportions of the hard phase composed of the complex boride and the matrix composed of the alloy phase are usually from 40 to 95% by weight, preferably from 55 to 90% by weight, and from 5 to 60% by weight, preferably from 5 to 45% by weight, respectively.

If the matrix is less than the above range, it becomes difficult to obtain a dense sintered body and the toughness tends to be low.

On the other hand, if the matrix exceeds 60% by weight, the heat resistance tends to be low, or deformation during sintering tends to be substantial.

Unavoidable impurities or other components which may be included during the process may be present to such an extent not to impair the purpose and effects of the sintered body of the present invention.

To obtain the complex boride cermet containing carbon according to the present invention, powders of e.g. MoB, WB, Mo and Ni and carbon or a carbide, particularly preferably a carbide selected from the carbides of metals of Groups 4B, 5B and 6B of the Periodic Table, are mixed to obtain a starting material mixture, which is milled in a wet system by using an organic medium such as ethanol by means of a rotary mill or a vibration mill, then a proper organic binder is added, as the case requires, and the mixture is dried, or dried and granulated, and then molded by e.g. die press or isostatic press.

The molded body is sintered at a temperature of at least 1,000° C., usually within a range of from 1,200° C. to 1,500° C., under vacuum, in a neutral atmosphere such as Ar or hydrogen, or in a reducing atmosphere.

The starting powder materials may not necessarily be the combination of MoB powder, WB powder, Mo powder and Ni powder. They may be a combination of Ni-B alloy powder, MoB powder, Mo powder, W powder and Ni powder. Otherwise, a complex boride is preliminarily synthesized, and the synthesized $Mo_2NiB_2$ powder or $(Mo_{1-x}W_x)_2NiB_2$ powder is combined with Ni powder and Mo powder. Or, single metal powders of Ni, Mo and W may be combined with B powder.

To the starting powder materials of such combination, a predetermined amount of carbon or a metal carbide is added.

The starting powder materials to be used should be as pure and as fine as possible to obtain a sintered body of a complex boride cermet having excellent properties.

When a molded body composed of the above starting materials is subjected to sintering, Mo, Ni, B and W components in the molded body react to one another during the temperature rising process to form a complex boride phase composed mainly of $Mo_2NiB_2$ or $(Mo_{1-x}W_x)_2NiB_2$. Such complex boride phase and the remaining metal phase composed mainly of Ni and containing Mo undergo a eutectic reaction to form a liquid phase.

Sintering proceeds with the aid of this liquid phase, whereby a dense sintered body having a relative density of almost 100% can readily be obtained.

The feature of the complex boride cermet of the present invention resides also in this liquid phase sintering, whereby a highly dense sintered body which can hardly be obtainable by solid phase sintering, can readily be obtained in a short period of time.

With the complex boride cermet of the present invention, the proportions of the matrix composed of the Ni alloy phase containing Mo and the complex boride phase after sintering are such that the matrix is from 5 to 60% by weight, preferably from 10 to 45% by weight, and the complex boride phase is from 40 to 95% by weight, preferably from 55 to 90% by weight, in view of the physical properties of the sintered cermet.

If the matrix is less than 5% by weight, the toughness tends to be inadequate. If the matrix exceeds 60% by weight, there will be a decrease in the hardness or the high temperature strength (heat resistance), and the deformation during the sintering tends to be substantial.

With respect to the type of the carbide to be added, it is preferred to employ at least one carbide selected from the carbides of metals of Groups 4B, 5B and 6B of the Periodic Table. By such addition of a carbide, an improvement in the strength is observed within a temperature range of from room temperature to as high as 900° C. In the case of a cermet containing carbon, the improvement in strength and hardness is particularly remarkable in a temperature range of from room temperature to 600° C.

The improvement in the strength and hardness is observed in every case where the above-mentioned carbides are added. Among them, an addition of TaC, NbC, WC or $Mo_2C$ is particularly superior in the effect for improving the strength and hardness.

The amount of the carbide to be added to the starting material is usually from 0.25 to 35% by weight, preferably from 0.4 to 30 wt%, whereby the effect of improving the strength is remarkable.

If the amount of the carbide is less than 0.25% by weight, no substantial effect for improvement in the strength of the sintered body is observed. On the other hand, if the amount exceeds 35% by weight, the strength and toughness, particularly the toughness tends to decrease, whereby the heat resistance and oxidation resistance, which are the merits of a boride cermet will be impaired.

The reason for the improvement in the strength by the addition of carbon or a carbide, may be explained as follows.

Namely, during the sintering a part or the majority of the added carbon or carbide is solid-solublized in the metal alloy phase of the matrix and in the hard phase of the complex boride as carbon or upon decomposition to metal and carbon elements, and the strength is considered to be improved by the solid-solubilization reinforcing effects of these elements.

Further, by the addition of carbon or the carbide, the structure of the sintered cermet changes. Particularly, the grain sizes of the complex boride crystal become fine. Accordingly, the addition of the carbon or the carbide are considered to be effective for suppressing the grain growth of the crystals of the complex boride and for the improvement of the strength and hardness.

With respect to the manner of addition of carbon or the carbide to the starting material, carbon powder such as carbon black or an organic binder capable of remaining carbon, such as a phenol resin, may be employed. Otherwise, it is particularly preferred to add it in the form of a carbide powder.

A similar effect can be obtained also by its addition in the form of a complex carbide such as $(Ta_{0.5}Nb_{0.5})C$.

In the sintered body of the complex boride cermet of the present invention, other components should be contained as little as possible. However, in addition to the impurities contained in the starting materials, Fe, Cr, Co, etc. introduced during the mixing and milling process of the starting material may be contained to such an extent not to impair the purpose of the present invention.

To prepare a complex boride cermet containing nitrogen according to the present invention, for example, MoB powder, WB powder, Mo powder and Ni powder having a proper particle size and purity, a predetermined amount of a nitride selected from the nitrides of metals of Groups 4B, 5B and 6B of the Periodic Table, are mixed, and the mixture is milled by using ethanol as a medium in a vibration mill or in a ball mill by using stainless steel balls and pot.

Further, a suitable organic binder may be added, dried and preferably granulated, and then it is molded by die press or isostatic press.

The molded body is sintered under a predetermined temperature condition under vacuum or in an atmosphere such as nitrogen or argon, to obtain a sintered body of a complex boride cermet.

As the starting materials to be used, powders of MoB, WB, Mo and Ni or a combination of powders of Mo, W, WB and Ni-B alloy, can be employed. To these starting powder mixture, a nitride or nitrides powder is added. The starting powder materials should be as pure and as fine as possible from the viewpoint of improvement in various properties of the sintered body as finally obtained. The following reaction is considered to take place during the sintering.

In the molded body, in the first stage, a crystal phase of a complex boride composed mainly of $Mo_2NiB_2$ or $(Mo_{1-x}W_x)_2NiB_2$ is formed and in the second stage, a liquid phase is formed by an eutectic reaction of such complex boride phase with the rest of the Ni alloy phase containing Mo, which leads the liquid phase sintering.

The amount of the matrix of the Ni alloy phase containing Mo in the sintered body is from 5 to 60% by weight, preferably from 10 to 45% by weight, whereby a complex boride cermet sintered body having particularly high strength can be obtained.

The amount of the nitride to be added is from 0.12 to 22% by weight, preferably from 1.0 to 15% by weight, as the total amount (at the time of mixing the starting materials) in the starting materials for a complex boride to form the hard phase and for metals phase to form the matrix, whereby a distinct effect for the improvement of the strength will be observed.

Namely, if the amount is too small, no substantial effect for the improvement of strength of the sintered body will be observed. On the other hand, if the amount is excessive, liberation of nitrogen due to decomposition of the nitride takes place, whereby the sintered body will be porous, and the apparent strength of the sintered body will be low. However, in such a case, it is possible to increase the upper limit of the amount by increasing the nitrogen partial pressure of the sintering atmosphere wherein the decomposition of the nitride is suppressed.

With respect to the type of the nitride to be added, it is preferred to add a nitride of a metal of Group 4a, 5a or 6a such as Ta, Nb, V, Ti or r, whereby both room temperature strength and high temperature strength will be improved.

Further, it has been found that TaN is particularly excellent in the effect for improving the strength.

The reason for the increase in the strength at room temperature and at high temperatures (as high as 900° C.) by the addition of nitrogen or a nitride, is considered to be as follows.

Firstly, nitrogen introduced from the atmosphere or from a part or most of the nitride added, will be dissolved directly or after decomposition into metal and nitrogen during the sintering (in some cases, a part of nitrogen will be released in the form of a $N_2$ gas) in the alloy phase composed mainly of Ni and containing Mo, which will form the matrix.

From the analyses of the sintered cermet by XMA and AES, metal elements of the nitrides added are found to be present in the hard phase of the complex boride and in the matrix of the metal phase and as distributed at the boundary between the hard phase and the metal phase matrix.

The metal elements are considered to be effective for reinforcing the respective portions and contribute to the improvement of the strength.

On the other hand, nitrogen is solid-solubilized particularly in the matrix metal phase, whereby it contributes to the strength, particularly to the improvement of the strength at high temperatures.

Further, the addition of a nitride gives a substantial effect on the structure of the sintered body, and it has been confirmed that the addition serves to suppress the grain growth of the complex boride crystals and is effective for obtaining uniform and fine grain size distribution.

All of such components are considered to contribute to the improvement of the strength and the toughness, particularly to the improvement of the high temperature strength.

With respect to the manner of addition of the nitride, the same effects can be obtained even when it is added in the form of a complex nitride such as $(Ti_{0.5}Ta_{0.5})N$.

It is possible to employ a method wherein nitrogen or a nitride is added (or solid-solubilized) from the atmosphere during sintering. However, this method has a drawback that a sintered body having a uniform structure can hardly be obtained especially when the size of the sintered body is large or the shape is complicated.

As the medium to be used for the step for mixing and milling the starting materials, ethanol is suitable in view of ease in handling and low toxicity to human bodies. However, methanol, isopropyl alcohol, acetone or hexane may also be used, since no substantial effect to the properties of the sintered body is thereby observed.

As the milling apparatus, it is preferred to use a vibration mill, because the treatment can be completed in a short period of time. However, a rotary ball mill or an attrition mill may also be employed. By any one of these mills, it is possible to obtain a starting material having a desired particle size. There was no significant difference among them in the structure or properties of the obtained cermet sintered bodies.

To obtain a sintered body of a complex boride cermet containing carbon and nitrogen according to the present invention, as a preferred method, a carbide or carbides of a metal selected from metals of Groups 4a, 5a and 6a and a nitride or nitrides of a metal selected from the metals of Groups 4B, 5B and 6B are mixed to powders of MoB, WB, Mo and Ni, and the mixture is mixed and milled by using an organic medium such as ethanol by a rotary mill or a vibration mill.

The slurry of the starting material is dried and, if necessary, granulated, and it is then molded by die press or isostatic press and then sintered at a temperature of at least 1,000° C., usually at a temperature of from 1,100° C. to 1,500° C., under vacuum, in a neutral atmosphere such as argon or hydrogen or in a reducing atmosphere.

As the starting powder materials, in addition to carbides and nitrides described above with respect to the production of a complex boride cermet, various starting materials containing carbon or nitrogen, a carbonitride may be employed.

When a molded body made of the starting material mixture is sintered, firstly, Mo, Ni, B and W components in the starting material react during the temprature rising step to form a complex boride phase of $Mo_2NiB_2$ or $(Mo_{1-x}W_x)_2NiB_2$, and then a liquid phase is formed by an eutectic reaction of the complex boride phase with the rest of the metal phase composed mainly of Ni and containing Mo.

Because of the liquid phase sintering, it is possible to easily obtain a dense sintered body of a complex boride cermet having a relative density of almost 100%.

Also in this case, the proportions of the matrix of the Ni alloy phase containing Mo and the complex boride phase after the sintering are preferably such that the matrix is from 5 to 60% by weight, preferably from 10 to 45% by weight, and the complex boride phase is from 40 to 95% by weight, preferably from 55 to 90% by weight, from the viewpoint of the properties of the sintered body of the complex boride cermet.

If the matrix is less than 5% by weight, the toughness tends to be inadequate. On the other hand, if the matrix exceeds 60% by weight, the hardness or the high temperature strength i.e. heat resistance, tends to be low, and deformation during the sintering tends to increase.

As a method of introducing carbon in the sintered body, in addition to the above-mentioned method of adding a carbide or a carbonitride, a method of adding a carbon powder such as carbon black or graphite powder to the starting powder mixture may be mentioned. However, when added in the form of a carbon powder, it is likely that the densification by sintering will be impaired since the wettability of the carbon powder with the liquid phase formed during sintering is poor.

Whereas, when carbon is added in the form of a metal carbide or carbonitride powder, preferably in the form of a carbide or carbonitride of a metal of Group 4B, 5B or 6B, particularly in the form of TaC, NbC, WC or $Mo_2C$, reinforcement by the solid-solution of these metal elements can also be expected, such being preferred.

The amount of carbon to be added is usually from 0.05 to 3% by weight, preferably from 0.1 to 2% by weight, based on the total weight of the sintered body, whereby a distinct effect for the improvement of the strength will be observed.

If the amount of carbon is less than 0.05% by weight, no substantial effect for the improvement in the strength of the sintered body will be observed. On the other hand, if the amount exceeds 3% by weight, the strength and toughness, particularly the toughness, tends to be low.

As a method of introducing nitrogen in the sintered body, it is convenient to employ a method of adding a metal nitride or carbonitride powder to the starting powder material as mentioned above, and it is effective for improving the high temperature strength of the sintered body.

When a nitride or a carbonitride of the metals of Groups 4B, 5B and 6B is added, an improvement of the strength at room temperature and high temperatures can effectively be obtained in any case. From the study of the present inventors, it has been found that the addition of TaN, NbN or TiN is particularly preferred from the viewpoint of the effectiveness for the improvement of strength.

The amount of nitrogen to be added is usually from 0.05 to 2% by weight, preferably from 0.1 to 1% by weight, based on the total weight of the sintered body, in view of the improvement in the properties of the sintered body.

If the amount of nitrogen added is less than 0.05% by weight, no substantial effect for the improvement in the strength of the sintered body will be observed. On the other hand, if the amount exceeds 2% by weight, nitrogen gas generated during the sintering tends to form pores in the sintered body, and such pores will remain as defects and lower the strength.

To investigate the effectiveness of added carbon, a metal element containing no carbon i.e. Ta, Nb, W or Mo was added in the form of simple substance to the starting powder mixture, and a complex boride cermet sintered body was prepared from it.

With this sintred body, the structure was not so fine as in the case where a carbide was added, and the strength was lower than the sintered body containing carbon.

Thus, it has been confirmed that the incorporation of carbon is effective for the improvement of the strength.

When the strength at room temperature and at 800° C. is compared between a sintered body prepared by an addition of a metal element as simple substance and a sintered body prepared by an addition of a nitride, an improvement in the strength at 800° C. is observed only with the sintered body prepared by the addition of a nitride. Therefore, it is considered that nitrogen solid-solubilized in the metal phase of the matrix serves to improve the heat resistance of the matrix.

Further, it has been confirmed that the addition of nitrogen is effective for suppressing remarkable grain growth and for unifying the particle size of the complex boride crystals in the sintered body of the complex boride cermet. As a result, deviation of the strength of the complex boride cermets can be minimized.

As described in the foregoing, the incorporation of carbon is effective particularly for the improvement of the room temperature strength of the sintered body, and the incorporation of nitrogen is effective particularly for the improvement of the high temperature strength and for reducing the deviation of the strength.

Further, when both carbon and nitrogen are incorporated, a synergistic effect of the above-mentioned effects will be obtained, whereby a further improvement in the strength of the sintered body will be obtained over the case where only carbon or nitrogen is incorporated.

With the complex boride cermet of the present invention, in most cases, the grain sizes of the complex boride crystals in the sintered body will be as fine as not larger than 3-4 μm in the majority e.g. at least 80%, and there will be substantially no grain having a grain size exceeding 5 μm. Thus, it is possible to obtain a dense sintered body having a relative density of at least 99.9%.

Now, the present invention will be described in further detail with reference to Examples. However, it should be understood that the present invention is by no means restricted by such specific Examples.

EXAMPLE (a) 10 A mixture comprising 55% by weight of MoB powder (purity: 99.5%, average paricle size: 5.4 μm), 35% by weight of Ni powder (purity: 99.5%, average particle size: 3 μm) and 10% by weight of WB powder (purity: 99.5%, average particle size: 3.5 μm), was mixed and milled for 24 hours in a wet system using an ethanol by a vibration mill. The powder mixture was dried under reduced pressure and then molded by pressing. The molded body was sintered at 1,250° C. for 30 minutes in vacuum to obtain a sintered body having a relative density of 99.5%.

This sintered body consisted of 82% by weight of a hard phase of complex boride crystals of $(Mo_{1-x}W_x)_2NiB_2$ having a particle size of at most 5 μm and 18% by weight of a matrix composed of a Ni alloy phase having a thickness of at most 2 μm filling the spaces of the hard phase crystals, and it was uniform and dense.

The properties of this sintered body were measured, whereby the bending strength was 200 kg/mm$^2$ at room temperature and 180 kg/mm$^2$ at 800° C., the fracture toughness (KIC) was 18.5 MN/m$^{3/2}$ (as measured by Sheveron notch method at a notch angle of 90°) and the Vickers hardness was 920 kg/mm$^2$.

EXAMPLES (b) to (i) and COMPARATIVE EXAMPLES (j) to (m)

To the same starting powder materials as used in Example (a) were used. The respective powder mixtures were mixed and milled, and then dried and molded by pressing. The molded body were sintered under the respective sintering conditions as identified in Table 1. The properties of the sintered bodies are also shown in Table 1.

EXAMPLE 1

49% by weight of MoB powder (purity: 99.5%, average particle size: 4.5 μm), 9% by weight of WB powder (purity: 99.5%, average particle size: 3.5 μm), 5% by weight of TaC powder (purity: 99.5%, average particle size: 1.1 μm), 4% by weight of Mo powder (purity: 99.9%, average particle size: 0.78 μm) and 33% by weight of carbonyl nickel powder (purity: 99.6%, average particle size: 2.8 μm) were weighed and mixed, and the mixture was milled in an ethanol medium for 24 hours by a vibration mill.

The slurry of the powder taken out from the mill was dried under reduced pressure, then subjected to isostatic press at 2 ton/cm$^2$ and sintered at 1,250° C. for one hour under a vacuumed condition of about $10^{-3}$ Torr.

The complex boride cermet sintered body thus obtained was composed of a matrix of an alloy phase composed mainly of Ni and containing Mo, Ta and C and $(Mo_{1-x}W_x)_2NiB_2$ crystals having an average grain size of about 2.5 μm and TaC crystals having an average grain size of about 2 μm both uniformly dispersed in the matrix.

Further, this sintered body had a relative density of 99.9%, a three point bending strength of 200 kg/mm$^2$ at room temperature and 185 kg/mm$^2$ at 800° C., a toughness ($K_{IC}$) of 18 MN/m$^{3/2}$ (as measured by Cheveron notch method at a notch angle of 90°) and a Vickers hardness of 1,170 kg/mm$^2$ at room temperature and 890 kg/mm$^2$ at 800° C.

EXAMPLES 2 TO 10

In the same manner as in Example 1, various sintered bodies were prepared. The properties of the sintered bodies thus obtained are shown by Examples 2 to 10 in Table 2.

Each sintered body thus obtained was composed of a hard phase comprising $Mo_2NiB_2$ or $(Mo_{1-x}W_x)_2NiB_2$ and a carbide, and a matrix composed of a Ni alloy phase containing Mo, surrounding the hard phase. By the presence of carbon, the $Mo_2NiB_2$ crystals or $(Mo_{1-x}W_x)_2NiB_2$ crystals were very fine as compared with those containing no carbon.

EXAMPLE 11

48% by weight of MoB powder (purity: 99.5%, average particle size: 4.5 μm), 9% by weight of WB powder (purity: 99.5%, average particle size: 3.5 μm), 4.8% by weight of Mo powder (purity: 99.5%, average particle size: 2.7 μm) and 33.2% by weight of Ni powder (purity: 99.7%, average particle size: 2.5 μm) were used as a basic composition, and 5% by weight of TaN was added thereto. The mixture was milled for 24 hours in a wet system using ethanol by a vibration mill.

The powder mixture was dried, and then molded by isostatic press at 2 ton/cm$^2$ and sintered at 1,275° C. for one hour under a vacuumed condition of about $10^{-3}$ Torr.

The sintered body thus obtained was a dense cermet wherein the hard phase was composed of $(Mo_{1-x}W_x)_2NiB_2$ and the matrix was composed of Ni, Mo and Ta.

This sintered body had a relative density of 99.9%, a three point bending strength of 220 kg/mm$^2$ at room temperature and 220 kg/mm$^2$ at 800° C., a toughness ($K_{IC}$) of 18.5 MN/m$^{3/2}$ (as measured by Cheveron notch method at a notch angel of 90°) and Vickers hardness ($H_V$) of 1,025 kg/mm$^2$ at room temperature and 909 kg/mm$^2$ at 800° C.

From the complex boride cermet of the present invention, a die for extruding copper rod was prepared and actually used, whereby the life was about three times longer than the conventional cemented carbide (WC-Co cermet) die, and the surface condition of the product was good.

EXAMPLES 12 TO 20

Complex boride cermets having various compositions were prepared in the same manner as in Example 11 to obtain sintered bodies, the properties of which are identified by Examples 12 to 20 in Table 2. In each of the sintered bodies of the complex boride cermets of the present invention consisted of a hard phase composed of $(Mo_{1-x}W_x)_2NiB_2$ or $Mo_2NiB_2$ and a matrix composed mainly of a Ni alloy phase containing Mo, whereby the complex boride crystals of the hard phase had a crystal structure of uniform and fine grain size without remarkable grain growth, by virtue of the nitrogen component incorporated.

COMPARATIVE EXAMPLES 21 TO 30

Sintered bodies of complex boride cermets were prepared in the same manner as in Example 1 or 11, and the properties as shown by Comparative Examples 21 to 30 in Table 2 were obtained.

Each of the obtained sintered bodies of complex boride cermets consisted mainly of a hard phase composed of a complex boride and a matrix composed of a Ni alloy phase containing Mo surrounding the hard phase of the complex boride.

EXAMPLE 31

38% by weight of MoB powder (purity: 99.5%, average particle size: 4.5 μm), 7% by weight of WB powder (purity: 99.5%, average particle size: 3.5 μm), 8% by weight of TaC powder (purity: 99.5%, average particle size: 1.1 μm), 4% by weight of TaN powder (purity: 99.4%, average particle size: 3 μm), 6% by weight of Mo powder (purity: 99.9%, average particle size: 0.78 μm) and 37% by weight of Ni powder (purity: 99.6%, average particle size: 2.8 μm), were prepared and mixed, and the mixture was milled for 24 hours in a wet system using a methanol medium by a vibration mill.

The slurry of the starting powder material was dried under reduced pressure, then molded by isostatic press at 2 ton/cm$^2$ and sintered at 1,275° C. for one hour under a vacuumed condition of about $10^{-3}$ Torr. The structure of the sintered body of composite boride cermet thus obtained composed mainly of crystal hard grains of very fine crystals of $(Mo_{1-x}W_x)_2NiB_2$by virtue of the addition of TaC, and the sintered body presented an ideal sintered body structure without remarkable grain growth by virtue of the addition of TaN.

Further, from the result of the analysis, it was found that a part of TaC and TaN added was decomposed during the sintering and dissolved in the matrix composed of the Ni alloy phase containing Mo.

This complex boride cermet sintered body had a relative density of 99.9%, a bending strength of 250 kg/mm$^2$ at room temperature and 205 kg/mm$^2$ at 800° C. in air, a toughness ($K_{IC}$) of 21 MN/m$^{3/2}$ and a Vickers hardness of 950 kg/mm$^2$ at room temperature and 800 kg/mm$^2$ at 800° C.

EXAMPLES 32 TO 44

Various sintered bodies of composite boride cermets were prepared in the same manner as in Example 31, and their properties were measured. The results are shown in Table 3.

With these complex boride cermet sintered bodies, the complex boride crystals of the hard phase were fine and no remarkable grain growth was observed by virtue of the incorporation of nitrogen and carbon.

COMPARATIVE EXAMPLES 51 TO 53

Sintered bodies of complex boride cermets containing no nitrogen and/or carbon were prepared in the same manner as in Example 31, and their properties were measured. The results are shown in Table 3. With these sintered bodies, the crystal sizes of the complex borides are generally large, for example, most of them are at least 5 μm, and in the sintered bodies containing no carbon or nitrogen, skeleton crystals due to remarkable grain growth were observed.

As described in the foregoing, the sintered bodies of the present invention do not substantially contain intermetallic compounds which bring about brittleness to the structure, and they are strengthened by the solid-solubilization of W and have high density, high strength and high toughness. Further, they are materials having the hardness and oxidation resistance characteristic to borides.

Further, the complex boride cermet of the present invention can be highly densified by pressureless sintering, and it has high strength and high toughness simultaneously. Further, it also has hardness, thermal shock resistance and oxidation resistance.

The complex boride cermet of the present invention has a feature that it is durable against oxidation in atmospheric air as high as about 900° C. and capable of maintaining its properties such as strength, which was not observed with the conventional cermets. Thus, the cermet of the present invention is most suitable for various dies or mechanical structural parts, particularly parts for application where high thermal resistance is required.

With respect to the effectivenes of incorporation of carbon and nitrogen, respectively, carbon is effective particularly for improving the strength and hardness within a temperature range of from room temperature to 600° C., and nitrogen is effective particularly for the improvement of the strength and toughness at a temperature of about 800° C.

With a complex boride cermet containing both carbon and nitrogen, a synergistic effect of two will be obtained, whereby a dense sintered body will be obtained in which the crystal structure of the hard phase is very fine, and it shows reliable high strength and high toughness within a temperature range of from room temperature to 900° C.

Further, since no large crystal particles are contained, it is possible to obtain a sintered body having little deviation in strength, whereby the allowable stress level will be substantially improved particularly in the case of a large sized sintered body or a sintered body having a complicated shape.

The foregoing indicates that the complex boride cermet of the present invention is a material useful also as a structural material.

The complex boride cermet of the present invention is essentially superior in the corrosion resistance and electrical conductivity, and therefore is useful for many applications including corrosion resistant part materials or electrodes for high temperature use. The specific gravity is light and is about ⅔ of cemented carbide, and thus the material can be produced at a correspondingly lower cost than the cemented carbide.

Thus, the complex boride cermet of the present invention is a cermet whereby the characteristic properties of the boride are advantageously utilized, and its practical value is significant.

TABLE 1

| | Batch composition *1 (wt %) | Matrix (wt %) | Molar ratio x in $(Mo_{1-x}W_x)_2NiB_2$ | Sintering condition *2 Temp. (°C.) | Sintering condition *2 Atmosphere |
|---|---|---|---|---|---|
| Example | | | | | |
| a | MoB—10WB—3Mo—32Ni | 18 | 0.09 | 1250 | Vacuum |
| b | MoB—14WB—1Mo—23Ni | 5 | 0.11 | 1350 | Vacuum |
| c | MoB—13WB—5Mo—33Ni | 24 | 0.13 | 1200 | Vacuum |
| d | MoB—30WB—2Mo—26Ni | 12 | 0.28 | 1225 | $H_2$ |
| e | MoB—5WB—6Mo—43Ni | 36 | 0.056 | 1175 | Ar |
| f | MoB—20WB—3Mo—29Ni | 16 | 0.19 | 1275 | Vacuum |
| g | MoB—6WB—1Mo—25Ni | 6 | 0.046 | 1250 | Vacuum |
| h | MoB—33WB—2Mo—25Ni | 12 | 0.31 | 1250 | Vacuum |
| i | MoB—48WB—1.5Mo—23.5Ni | 10 | 0.49 | 1250 | Vacuum |
| Comparative Example | | | | | |
| j | MoB—25Ni | 4 | 0 | 1250 | Vacuum |
| k | MoB—2WB—28Ni | 8 | 0.015 | 1250 | Vacuum |
| l | MoB—20WB—22Ni | 3 | 0.16 | 1400 | Vacuum |
| m | MoB—7Mo—5Mn—30Ni | 26 | 0 | 1285 | Vacuum |

| | Properties of sintered bodies: Bending strength (kg/mm) Room temp. | Bending strength (kg/mm) 800° C. | Toughness ($K_{IC}$) *3 ($MN/m^{3/2}$) | Vickers hardness ($kg/mm^2$) | Porosity (%) | Unavoidable impurities (wt %) |
|---|---|---|---|---|---|---|
| Example | | | | | | |
| a | 200 | 180 | 18.5 | 920 | <0.1 | Fe <5.0, Cr <0.5 |
| b | 150 | 160 | 12 | 1580 | <0.1 | Fe <5.0, Cr <0.5 |
| c | 220 | 180 | 29 | 780 | <0.1 | Fe <5.0, Cr <0.5 |
| d | 200 | 190 | 17 | 830 | <0.1 | Fe <5.0, Cr <0.5 |
| e | 235 | 170 | 22 | 710 | <0.1 | Fe <5.0, Cr <0.5 |
| f | 195 | 185 | 17 | 1000 | <0.1 | Fe <5.0, Cr <0.5 |
| g | 165 | 170 | 18 | 980 | <0.1 | Co <3.0, Fe <0.5 |
| h | 190 | 180 | 17 | 970 | <0.1 | Fe <5.0, Cr <0.5 |
| i | 190 | 185 | 18 | 870 | <0.1 | Fe <5.0, Cr <0.5 |

TABLE 1-continued

| Comparative Example | | | | | | |
|---|---|---|---|---|---|---|
| j | 145 | 135 | 17 | 950 | <0.1 | Fe <5.0, Cr <0.5 |
| k | 150 | 135 | 17 | 980 | <0.1 | Fe <5.0, Cr <0.5 |
| l | 80 | 90 | 6 | 1610 | <0.1 | Fe <5.0, Cr <0.5 |
| m | 150 | 120 | 13.5 | 950 | 1.5 | Fe <5.0, Cr <0.5 |

*1: Balance being the first component.
*2: Firing time was one hour in each case.
*3: Measured by Cheveron notch method.

TABLE 2

| | Batch composition *1 (wt %) | Matrix (wt %) | Carbon content (wt %) | Nitrogen content (wt %) | Sintering condition *2 Temp. (°C.) | Sintering condition *2 Atmosphere |
|---|---|---|---|---|---|---|
| Example | | | | | | |
| 1 | MoB—9WB—5TaC—4Mo—33Ni | 23 | 0.32 | — | 1250 | Vacuum |
| 2 | MoB—7WB—17WC—0.5CrC—6Mo—38Ni | 33 | 1.06 | — | 1225 | Vacuum |
| 3 | MoB—5WB—2NbC—1.5Mo—24Ni | 7 | 0.23 | — | 1325 | Vacuum |
| 4 | MoB—9WB—26MoC—4.5Mo—45Ni | 44 | 1.53 | — | 1250 | Vacuum |
| 5 | MoB—8WB—7TaC—1TiC—6.5Mo—42Ni | 37 | 0.63 | — | 1250 | Ar |
| 6 | MoB—14WB—0.5VC—4Mo—35Ni | 34 | 0.10 | — | 1250 | Vacuum |
| 7 | MoB—5WB—0.5ZrC—1Mo—43Ni | 29 | 0.06 | — | 1275 | Vacuum |
| 8 | NiB—9WB—11NbC—48Mo | 15 | 1.26 | — | 1250 | Vacuum |
| 9 | MoB—10WB—30TaC—3TiC—7Mo—35Ni | 28 | 2.75 | — | 1300 | Vacuum |
| 10 | MoB—15$Mo_2C$—7TiC—8Mo—30Ni | 25 | 2.15 | — | 1320 | Vacuum |
| 11 | MoB—9WB—4.8Mo—5TaN—33.2Ni | 10 | <0.01 | 0.36 | 1275 | Vacuum |
| 12 | MoB—7WB—4TiN—1.5Mo—24.5Ni | 7 | <0.01 | 0.65 | 1325 | Vacuum |
| 13 | MoB—6WB—3TaN—5Mo—34Ni | 30 | <0.01 | 0.20 | 1275 | Vacuum |
| 14 | MoB—4.5WB—2NbN—7.5TaN—5Mo—34Ni | 25 | <0.01 | 0.80 | 1275 | Vacuum |
| 15 | MoB—7WB—2.5VN—7.5Mo—44Ni | 40 | <0.01 | 0.53 | 1250 | $N_2$ |
| 16 | MoB—3WB—4.5TaN—28Mo—16.5NiB—24.5Ni | 30 | <0.01 | 0.28 | 1275 | $N_2$ |
| 17 | MoB—1.5WB—1ZrN—6.5TaN—26.5Mo—14.5NiB—28.5Ni | 35 | <0.01 | 0.27 | 1250 | Vacuum |
| 18 | MoB—5WB—10TiN—8Mo—40Ni | 37 | <0.01 | 1.88 | 1285 | $N_2$ |
| 19 | MoB—12TaN—10Mo—33Ni | 31 | <0.01 | 1.02 | 1285 | $N_2$ |
| 20 | MoB—5WB—1.5TaN—6.5Mo—30Ni | 30 | <0.01 | 0.03 | 1300 | Vacuum |
| Comparative Example | | | | | | |
| 21 | MoB—25WB—40Ni | 28 | <0.01 | — | 1225 | Vacuum |
| 22 | MoB—13WB—7Mo—43Ni | 38 | <0.01 | — | 1250 | Ar |
| 23 | NiB—10WB—54Mo | 16 | <0.01 | — | 1300 | Vacuum |
| 24 | NiB—8WB—4Mo—40Ni | 30 | <0.01 | — | 1275 | Vacuum |
| 25 | MoB—7.5WB—7.5Mo—45Ni | 40 | <0.01 | — | 1250 | Ar |
| 26 | MoB—5.5WB—30Mo—14Ni—14NiB | 15 | <0.01 | — | 1300 | Vacuum |
| 27 | MoB—10WB—25TiN—7Mo—35Ni | 33 | <0.01 | 2.35 | 1300 | $N_2$ |
| 28 | MoB—35TiC—5TaC—3Mo—40Ni | 38 | 3.92 | — | 1285 | Vacuum |
| 29 | MoB—8WB—4Mo—5AlN—40Ni | 37 | <0.01 | 1.88 | 1300 | $N_2$ |
| 30 | MoB—10WB—3Mo—10Co—25Ni | 25 | <0.01 | — | 1285 | Vacuum |

| | Properties of sintered bodies: Bending strength (kg/mm²) Room temp. | Bending strength (kg/mm²) 800° C. | Toughness ($K_{IC}$) *3 ($MN/m^{3/2}$) | Vickers hardness ($kg/mm^2$) | Porosity (%) | Unavoidable impurities (wt %) |
|---|---|---|---|---|---|---|
| Example | | | | | | |
| 1 | 200 | 180 | 18.0 | 1170 | <0.1 | Fe <5.0, Cr <0.5 |
| 2 | 220 | 185 | 19.0 | 990 | <0.1 | Fe <5.0, Cr <0.5 |
| 3 | 175 | 160 | 14.0 | 1360 | <0.1 | Fe <5.0, Cr <0.5 |
| 4 | 230 | 190 | 20.0 | 890 | <0.1 | Fe <5.0, Cr <0.5 |
| 5 | 280 | 215 | 21.5 | 980 | <0.1 | Fe <5.0, Cr <0.5 |
| 6 | 205 | 175 | 18.5 | 940 | <0.1 | Fe <5.0, Cr <0.5 |
| 7 | 220 | 170 | 19.0 | 1190 | <0.1 | Fe <5.0, Cr <0.5 |
| 8 | 220 | 220 | 19.0 | 1140 | <0.1 | Fe <5.0, Cr <0.5 |
| 9 | 220 | 200 | 19.5 | 1100 | <0.1 | Fe <5.0, Cr <0.5 |
| 10 | 210 | 185 | 17.0 | 1150 | <0.1 | Fe <5.0, Cr <0.5 |
| 11 | 220 | 220 | 18.5 | 1025 | <0.1 | Fe <5.0, Cr <0.5 |
| 12 | 170 | 165 | 14.5 | 1350 | <0.1 | Fe <5.0, Cr <0.5 |
| 13 | 230 | 235 | 18.5 | 1050 | <0.1 | Fe <5.0, Cr <0.5 |
| 14 | 220 | 215 | 18.0 | 1100 | <0.1 | Fe <5.0, Cr <0.5 |
| 15 | 200 | 195 | 20.0 | 910 | <0.1 | Fe <5.0, Cr <0.5 |
| 16 | 240 | 235 | 20.0 | 990 | <0.1 | Fe <5.0, Cr <0.5 |
| 17 | 210 | 210 | 20.0 | 950 | <0.1 | Fe <5.0, Cr <0.5 |
| 18 | 200 | 195 | 20.0 | 950 | <0.1 | Fe <5.0, Cr <0.5 |
| 19 | 190 | 200 | 17.0 | 1030 | <0.1 | Fe <5.0, Cr <0.5 |
| 20 | 190 | 195 | 18.5 | 1070 | <0.1 | Fe <5.0, Cr <0.5 |
| Comparative | | | | | | |

TABLE 2-continued

| Example | | | | | | |
|---|---|---|---|---|---|---|
| 21 | 200 | 190 | 17.0 | 830 | <0.1 | Fe <5.0, Cr <0.5 |
| 22 | 200 | 185 | 18.5 | 920 | <0.1 | Fe <5.0, Cr <0.5 |
| 23 | 165 | 125 | 14.0 | 1320 | <0.1 | Fe <5.0, Cr <0.5 |
| 24 | 200 | 165 | 17.0 | 1030 | <0.1 | Fe <5.0, Cr <0.5 |
| 25 | 185 | 145 | 18.5 | 920 | <0.1 | Fe <5.0, Cr <0.5 |
| 26 | 160 | 120 | 14.0 | 1330 | <0.1 | Fe <5.0, Cr <0.5 |
| 27 | 160 | 150 | 16.0 | 880 | 5.5 | Fe <5.0, Cr <0.5 |
| 28 | 170 | 155 | 15.0 | 870 | <0.1 | Fe <5.0, Cr <0.5 |
| 29 | 140 | 115 | 14.0 | 850 | 3.7 | Fe <5.0, Cr <0.5 |
| 30 | 155 | 140 | 13.0 | 990 | <0.1 | Fe <5.0, Cr <0.5 |

*1: Balance being the first component.
*2: Firing time was one hour in each case.
*3: Measured by Cheveron notch method.

TABLE 3

| | Batch composition *1 (wt %) | Matrix (wt %) | Carbon content (wt %) | Nitrogen content (wt %) | Sintering condition *2 Temp. (°C.) | Sintering condition *2 Atmosphere |
|---|---|---|---|---|---|---|
| Example | | | | | | |
| 31 | MoB—7WB—8TaC—4TaN—6Mo—37Ni | 31 | 0.5 | 0.3 | 1275 | Vacuum |
| 32 | MoB—8WB—8TaC—4Tan—5Mo—32Ni | 23 | 0.6 | 0.1 | 1275 | Ar |
| 33 | MoB—7WB—12TaC—4TaN—7Mo—39Ni | 36 | 0.8 | 0.3 | 1260 | Vacuum |
| 34 | MoB—8WB—11TaC—2TiN—2Mo—26Ni | 13 | 0.6 | 0.5 | 1280 | Vacuum |
| 35 | MoB—8WB—9NbC—2TiN—5Mo—33Ni | 25 | 1.0 | 0.5 | 1275 | Vacuum |
| 36 | MoB—8WB—1ZrC—5TaN—5Mo—35Ni | 28 | 0.1 | 0.4 | 1275 | Vacuum |
| 37 | MoB—7WB—15WC—2TaN—6Mo—38Ni | 33 | 1.0 | 0.1 | 1260 | Vacuum |
| 38 | $Mo_2NiB_2$—$7W_2NiB_2$—5TiCN—7Mo—31Ni | 38 | 0.5 | 0.6 | 1275 | Vacuum |
| 39 | MoB—8WB—4NbN—8TaC—5Mo—33Ni | 24 | 0.5 | 0.5 | 1275 | $ArN_2$ |
| 40 | NiB—9WB—3NbN—8NbC—48Mo | 15 | 0.9 | 0.4 | 1275 | Vacuum |
| 41 | $Mo_2NiB_2$—$5TaCo_{0.5}N_{0.5}$—4Mo—19Ni | 23 | 0.16 | 0.15 | 1275 | Vacuum |
| 42 | $Mo_2NiB_2$—$7W_2NiB_2$—$5TiC_{0.5}N_{0.5}$—7Mo—31Ni | 38 | 0.55 | 0.56 | 1275 | $N_2$ |
| 43 | MoB—9WB—$2TiC_{0.5}N_{0.5}$—4TaN—8Mo—46Ni | 45 | 0.2 | 0.25 | 1240 | Vacuum |
| 44 | MoB—9WB—$14.5TaC_{0.5}N_{0.5}$—4.5Mo—32Ni | 24 | 0.53 | 0.3 | 1275 | Vacuum |
| Comparative Example | | | | | | |
| 51 | MoB—7WB—7Mo—39Ni | 33 | 0 | 0 | 1250 | Vacuum |
| 52 | MoB—9WB—8TaC—5Mo—32Ni | 23 | 0.5 | 0 | 1250 | Vacuum |
| 53 | MoB—9WB—4Tan—5Mo—26Ni | 22 | 0 | 0.3 | 1275 | Vacuum |

| | Properties of sintered bodies: Bending strength ($kg/mm^2$) Room temp. | Bending strength ($kg/mm^2$) 800° C. | Toughness ($K_{IC}$) *3 ($MN/mm^{3/2}$) | Vickers hardness ($kg/mm^2$) | Porosity (%) | Unavoidable impurities (wt %) |
|---|---|---|---|---|---|---|
| Example | | | | | | |
| 31 | 250 | 205 | 21 | 950 | <0.1 | Fe <5.0, Cr <0.5 |
| 32 | 250 | 205 | 21 | 950 | <0.1 | Fe <5.0, Cr <0.5 |
| 33 | 280 | 235 | 23 | 820 | <0.1 | Fe <5.0, Cr <0.5 |
| 34 | 215 | 210 | 17 | 1200 | <0.1 | Fe <5.0, Cr <0.5 |
| 35 | 225 | 195 | 20 | 1050 | <0.1 | Fe <5.0, Cr <0.5 |
| 36 | 205 | 200 | 19 | 980 | <0.1 | Fe <5.0, Cr <0.5 |
| 37 | 250 | 205 | 20 | 990 | <0.1 | Fe <5.0, Cr <0.5 |
| 38 | 225 | 215 | 21 | 930 | <0.1 | Fe <5.0, Cr <0.5 |
| 39 | 230 | 195 | 19 | 1080 | <0.1 | Fe <5.0, Cr <0.5 |
| 40 | 215 | 200 | 18 | 1140 | <0.1 | Fe <5.0, Cr <0.5 |
| 41 | 215 | 200 | 28 | 1160 | <0.1 | Fe <5.0, Cr <0.5 |
| 42 | 225 | 215 | 20.5 | 930 | <0.1 | Fe <5.0, Cr <0.5 |
| 43 | 210 | 205 | 23 | 850 | <0.1 | Fe <5.0, Cr <0.5 |
| 44 | 185 | 190 | 19 | 1100 | <0.1 | Fe <5.0, Cr <0.5 |
| Comparative Example | | | | | | |
| 51 | 190 | 155 | 17 | 800 | <0.1 | Fe <5.0, Cr <0.5 |
| 52 | 210 | 170 | 16 | 1000 | <0.1 | Fe <5.0, Cr <0.5 |
| 53 | 185 | 175 | 18 | 980 | <0.1 | Fe <5.0, Cr <0.5 |

*1: Balance being the first component.
*2: Firing time was one hour in each case.
*3: Measured by Cheveron notch method.

What is claimed is:

1. A complex boride cermet having high strength and high toughness, which comprises a hard phase consisting essentially of a complex boride ($(MO_{1-x}W_x)_2NiB_2$), the molar ratio x of tungsten substituted for molybdenum is within the range of from 0.04 to 0.40 , being a solid solution of a nickel-molybdenum complex boride ($MO_2NiB_2$), and a matrix of an alloy phase consisting essentially of nickel and containing molybdenum.

2. The complex boride cermet according to claim 1, wherein the hard phase of the complex boride is from 40 to 90% by weight, and the matrix alloy phase is from 10 to 60% by weight.

3. The complex boride cermet according to claim 1, wherein the hard phase of the complex boride is from 40 to 95% by weight, the matrix alloy phase is from 5 to 60 % by weight, and the matrix alloy phase contains at least 40% by weight of nickel.

4. A sintered complex boride cermet having high strength and high toughness, which comprises a hard phase consisting essentially of a nickel-molybdenum complex boride wherein a portion of the molybdenum is substituted by tungsten, and a matrix phase of an alloy consisting essentially of nickel and containing molybdenum, the sintered cermet product containing carbon within its structure.

5. The complex boride cermet according to claim 4, wherein the matrix alloy phase contains at least 40% by weight of nickel.

6. The complex boride cermet according to claim 4, which contains carbon in the sintered body and which further contains at least one metal selected from the group consisting of metals of Groups 4B and 5B of the Periodic Table and chromium.

7. The complex boride cermet according to claim 6, which contains from 5 to 60% by weight of the matrix alloy phase.

8. The complex boride cermet according to claim 6, wherein carbon contained in the sintered body is from 0.05 to 3.0% by weight, and the total content of the metals of Groups 4B and 5B of the Periodic Table and chromium is from 0.2 to 32% by weight.

9. The complex boride cermet according to claim 8, which contains one or both of tantalum and niobium in the sintered body.

10. The complex boride cermet according to claim 9, which contains from 5 to 60% by weight of the matrix alloy phase wherein the total content of tantalum and niobium is from 0.5 to 32% by weight, and the content of the carbon is from 0.05 to 3.0% by weight.

11. A process for producing a sintered complex boride cermet having high strength and high toughness which comprises a hard phase consisting essentially of a nickel-molybdenum complex boride, wherein the molybdenum is partially substituted by tungsten, and a matrix phase of an alloy consisting essentially of nickel as the main phase and molybdenum, comprising:

adding a carbide or carbides of a metal selected from the group of elements of groups 4B, 5B and 6B of the Periodic table in an amount of from 0.25 to 35% by weight to the raw material constituency of the boride hard phase and the nickel-molybdenum matrix phase; and sintering the mixture obtained.

12. A sintered complex boride cermet having high strength and high toughness, which comprises a hard phase consisting essentially of a nickel-molybdenum complex boride wherein a portion of the molybdenum is substituted by tungsten, and a matrix phase of an alloy consisting essentially of nickel as a main component and molybdenum, the sintered cermet product containing nitrogen.

13. The complex boride cermet according to claim 12, which contains nitrogen in the sintered body and which further contains at least one metal selected from the metals of Groups 4B and 5B of the Periodic Table and chromium.

14. The complex boride cermet according to claim 12, which contains from 5 to 60% by weight of the matrix alloy phase.

15. The complex boride cermet according to claim 12, which contains from 10 to 45% by weight of the matrix alloy phase.

16. The complex boride cermet according to claim 13, wherein nitrogen contained in the sintered body is from 0.02 to 2.0% by weight, and the total content of metals of Groups 4B and 5B of the periodic Table and chromium is from 0.1 to 20% by weight.

17. The complex boride cermet according to claim 13, which contains tantalum of Group 5B in the sintered body.

18. The complex boride cermet according to claim 13 which contains from 5 to 60% by weight of the matrix alloy phase, from 0.2 to 20% by weight of tantalum of Group 5a and from 0.02 to 1.2% by weight of nitrogen in the sintered body.

19. A process for producing a sintered complex boride cermet having high strength and high toughness which comprises a hard phase consisting essentially of nickel-molybdenum complex boride, wherein a portion of the molybdenum is substituted by tungsten, and a matrix phase of an alloy consisting essentially of nickel as a main component and containing molybdenum, comprising:

adding a nitride or nitrides of a metal selected from the group consisting of the elements of groups 4B, 5B and 6B of the Periodic table in an amount of from 0.12 to 22% by weight to the raw material constitutency of the boride hard phase and the nickel-molybdenum matrix phase; and then sintering the mixture obtained.

20. A sintered complex boride cermet having high strength and high toughness, which comprises a hard phase consisting essentially of a nickel-molybdenum complex boride, wherein a portion of the molybdenum is substituted by tungsten, and a matrix phase of an alloy consisting essentially of nickel as the main component and containing molybdenum, the sintered cermet product obtained containing nitrogen and carbon.

21. The complex boride cermet according to claim 20, which further contains at least one metal selected from the metals of Groups 4B and 5B of the Periodic Table and chromium.

22. The complex boride cermet according to claim 20, which contains from 5 to 60% by weight of the matrix alloy phase.

23. The complex boride cermet according to claim 20, which contains from 10 to 45% by weight of the matrix alloy phase.

24. The complex boride cermet according to claim 20, wherein carbon contained in the sintered body is from 0.05 to 3% by weight, and nitrogen contained in the sintered body is from 0.02 to 2% by weight.

25. The complex boride cermet according to claim 20, wherein carbon contained in the sintered body is from 0.1 to 2% by weight, and nitrogen contained in the sintered body is from 0.05 to 1% by weight.

26. The complex boride cermet according to claim 22, wherein carbon contained in the sintered body is from 0.05 to 3% by weight, and nitrogen contained in the sintered body is from 0.02 to 2% by weight.

27. The complex boride cermet according to claim 23, wherein carbon contained in the sintered body is from 0.1 to 2% by weight, and nitrogen contained in the sintered body is from 0.1 to 1% by weight.

28. A process for producing a sintered complex boride cermet having high strength and high toughness which comprises a hard phase consisting essentially of a nickel-molybdenum complex boride, wherein a portion of the molybdenum is substituted by tungsten, and matrix phase of an alloy consisting essentially of nickel as the main component and containing molybdenum, comprising:

adding a carbide or carbides and a nitride or nitrides of a metal selected from the group consisting of metals of groups 4B, 5B and 6B of the Periodic table to the raw material constituency of the boride hard phase and the nickel-molybdenum matrix phase; and then sintering the mixture obtained.

* * * * *